US006439568B1

(12) United States Patent
Kinson et al.

(10) Patent No.: US 6,439,568 B1
(45) Date of Patent: Aug. 27, 2002

(54) REMOTE SHEET ADVANCE DEVICE AND METHOD

(75) Inventors: Robert David Kinson, Sidney; Kenneth John Herman, St. Marys; James M. Brandewie, Fort Laramie, all of OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 138 days.

(21) Appl. No.: 09/660,150

(22) Filed: Sep. 13, 2000

(51) Int. Cl.[7] ..... B65H 1/02
(52) U.S. Cl. ..... 271/149; 271/150; 271/152
(58) Field of Search ..... 271/94, 31, 38, 271/110, 112, 114, 126, 130, 152, 153, 154, 155, 258.01, 149, 150

(56) References Cited

U.S. PATENT DOCUMENTS 4,566,685 A * 1/1986 Irvine et al. ..... 271/150
4,600,185 A 7/1986 Moll ..... 270/58
5,615,876 A * 4/1997 Yergenson et al. ..... 271/258.01
5,984,298 A * 11/1999 Wada et al. ..... 271/114 X
6,000,690 A * 12/1999 Kudoh ..... 271/114 X
6,126,161 A * 10/2000 Kato ..... 271/114 X
6,129,347 A * 10/2000 Brooks et al. ..... 271/126 X
6,257,569 B1 * 7/2001 Rhodes et al. ..... 271/114 X

* cited by examiner

*Primary Examiner*—David H. Bollinger
(74) *Attorney, Agent, or Firm*—Davidson, Davidson & Kappel, LLC

(57) ABSTRACT

A sheet advance device has a transport device for transporting a stack of sheets in a first direction, a feed finger located in the path of the stack of sheets for contacting the stack of sheets, a sensor for detecting a movement of the feed finger; and an externally-located adjustment device for positioning of the feed finger. Also provided is a method for advancing sheets on a transport device comprising the steps of moving a stack of sheets on the transport device against a feed finger so as to move the feed finger in a first direction, sensing the movement of the feed finger so as to generate a stop signal, stopping the transport device as a function of the stop signal, removing individual sheets from the stack of sheets so as to reduce the stack in a direction opposite the first direction and move the feed finger opposite the first direction, moving the transport device in the first direction after the removing step, and adjusting a position of the feed finger through an externally-located adjustment device.

15 Claims, 3 Drawing Sheets

REMOTE SHEET ADVANCE DEVICE AND METHOD

BACKGROUND OF THE INVENTION

1. Field of the Invention

The present invention relates generally to paper or like material handling machines and more particularly to a device and method for remotely advancing sheets.

2. Background Information

Sheets of material, for example printed sheets of paper, often are stacked and fed by belts to processing machines, such as folding machines which take individual sheets of paper from the stack and fold them. The lead edge of the stack often is used to activate a switch, which controls the feed or motion of the stack.

U.S. Pat. No. 4,600,185 purports to disclose an apparatus for detecting and actuating the feeding of paper in paper folding machines. A scanning head positioned adjacent to an underside of the paper load reads the paper load from the bottom. The scanning head is located on an upper end of an arm which is adjustable through the movement relative to two perpendicular shafts. The scanning head can provide a signal to control the paper feed.

This patent has the disadvantage that a scanning head is used to sense the paper edge, which can malfunction due to dust or other contamination blocking the scanning head. Moreover, the positioning of the scanning head requires the operator to place hands near the feeding mechanism, which can be inconvenient and require that the operator reach under the scanning head. The nuts used to position the scanning head also might move due to vibrations of the machine, causing the position of the scanning head to be altered.

BRIEF SUMMARY OF THE INVENTION

An object of the present invention is to provide a method and device for reliable advancing of sheets. Another additional or alternative object of the present invention is to provide for a feed finger which can be easily positioned.

The present invention provides a sheet advance device comprising a transport device for transporting a stack of sheets in a first direction; a feed finger located in the path of the stack of sheets for contacting the stack of sheets; and a sensor for detecting a movement of the feed finger. A position of the feed finger is adjustable by an adjustment device located externally with respect to a frame of the sheet advance device.

Since the adjustment device is located remotely from the feed finger, an operator advantageously may adjust the feed finger positioning from the frame or from beyond the frame without have to reach within the sheet advance device.

The feed finger preferably is supported on disk mounted rotatably on a support assembly, the support assembly including two perpendicular slideways for positioning the disk. The adjustment device preferably includes two knobs located on an outer surface of the frame, and two flex shafts connect the two knobs to the two slideways.

The feed finger and disk may be spring-loaded in a direction opposite the first direction.

The sheet advance device of the present invention provides that physical contact by the sheets triggers the feed finger, which is easily positioned without having to reach inside the device. As individual sheets of the stack are removed, the spring-loading moves the feed finger opposite the first direction, thereby triggering the transport device to move in the first direction.

The sensor preferably includes a sensor plate connected to the disk and a proximity switch located next to the sensor plate. When the sensor plate touches the proximity switch, belts of the transport device on which the sheets are located can be stopped. As the individual sheets are removed from the stack, the disk, which is spring-loaded, can rotate so that the sensor plate again moves away from the proximity switch, and the belts can be moved again.

Adjustment of the position of the feed finger can be achieved by the two slideways, one of which is preferably in a horizontal plane and the other in a vertical plabe. By adjusting the position of the feed finger, fine positioning of the stack with respect to a removal device, for example a suction wheel, can be achieved.

The present invention also provides a method for advancing sheets on a transport device comprising the steps of:

moving a stack of sheets on the transport device against a feed finger so as to move the feed finger in a first direction;

sensing the movement of the feed finger so as to generate a stop signal;

stopping the transport device as a function of the stop signal;

removing individual sheets from the stack of sheets so as to reduce the stack in a direction opposite the first direction and move the feed finger opposite the first direction;

moving the transport device in the first direction after the removing step; and adjusting a position of the feed finger through an externally-located adjustment device.

The feed finger preferably is spring-loaded to move opposite the first direction. The feed finger may be located on a rotatable disk, with a sensor sensing a rotation of the disk to generate the stop signal.

The transport device preferably includes at least one belt.

BRIEF DESCRIPTION OF THE DRAWINGS

A preferred embodiment of the present invention is described below by reference to the following drawings, in which.

DETAILED DESCRIPTION

Figure 1:
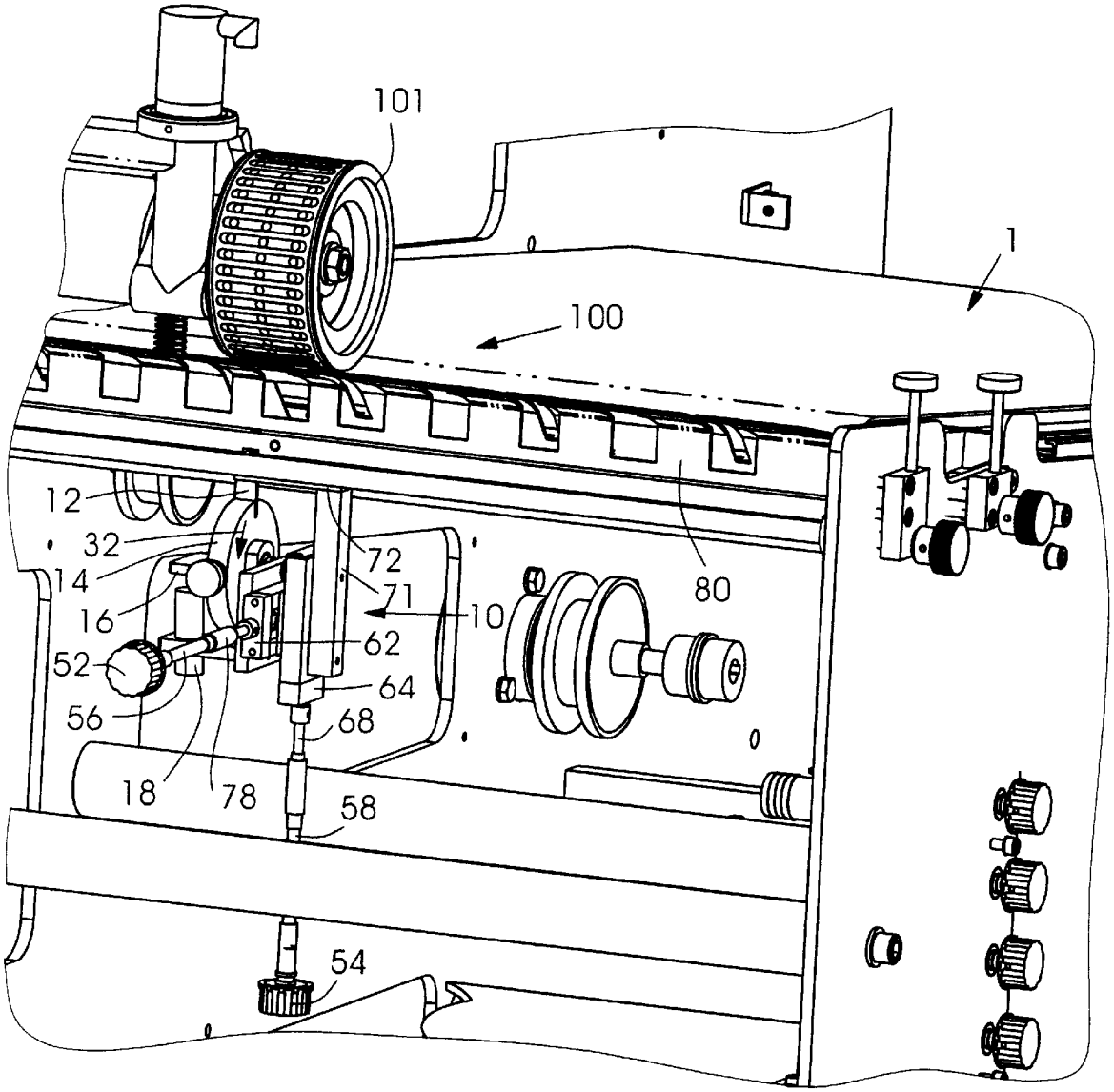
FIG. 1 shows a perspective view of the sheet advance device according to the present invention attached to a folding device.

FIG. 1 shows a sheet advance device 1 attached to the underside of a folding device 100 having a suction wheel 101 for removing individual sheets of paper from a stack of sheets held on a belt. Sheet advance device 1 includes a transport device for moving a stack of sheets on belts, and a control device 10 for automatically controlling the operation of the transport device. The control device 10 includes a feed finger 12 which extends into the path of the transport device so as to be contacted by the stack of sheets. Feed finger 12 is supported on a rotatable disk 14, which is spring-loaded against the direction of movement of the transport device.

Figure 3:
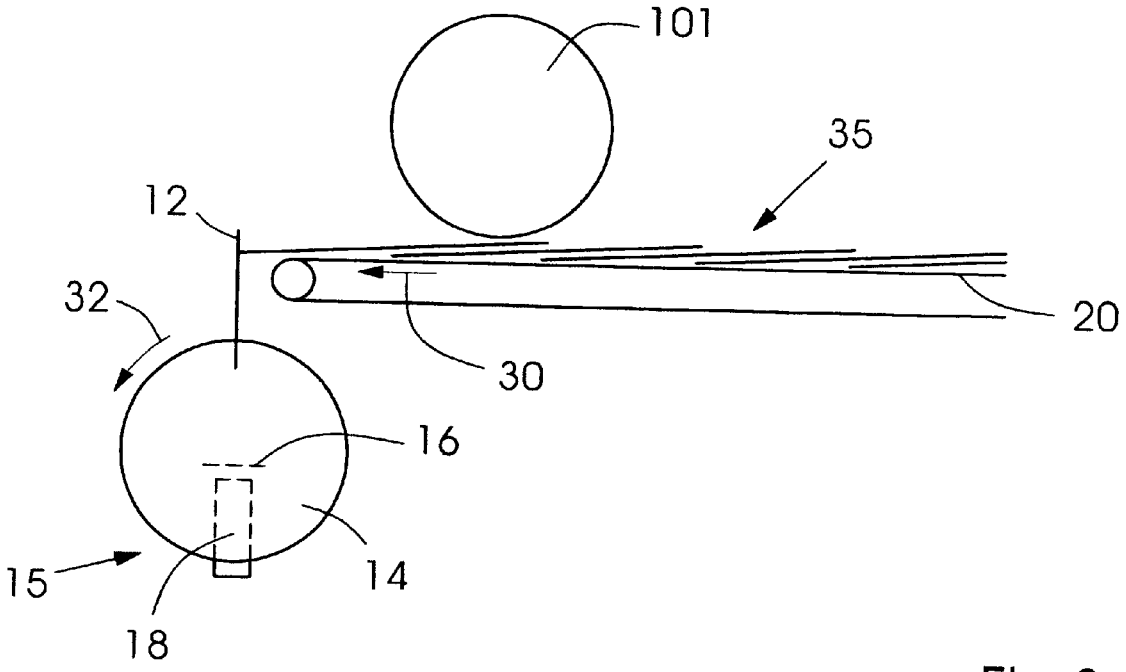
FIG. 3 shows a side view of the sheet advance device according to FIG. 1.

FIG. 3 shows a schematic side view of the device of FIG. 1. Stack of sheets 35 is on a belt 20 of the transport device and moves in direction 30 through the action of the belt 20. Belt 20 runs around a roller before reaching feed finger 12, so that sheets 35 extend beyond the surface of belt 20 and can contact feed finger 12. Stack 35 thus causes feed finger 12 to move in direction 30, thereby rotating disk 14 in direction 32. A sensor 15 can detect the rotation of disk 14 and may include a sensor plate 16 fixed to the disk 14 and a non-rotatable proximity switch 18, which provides a signal when sensor plate 16 contacts the proximity switch 18. FIG. 1 also shows plate 16 and proximity switch 18.

When the stack 35 moves against the feed finger 12, the disk 14 rotates so that plate 16 contacts switch 18, thus generating a stop signal. The stop signal is sent electronically to the transport device so as to stop belts 20 from moving.

Suction wheel 101 removes individual sheets from stack 35, for feeding, for example, to a folding machine. As the sheets are removed from the front of stack 35, disk 14, which is spring-loaded to oppose rotation of disk 14 in direction 32, rotates opposite direction 32. Sensor plate 16 thus rotates so that contact is removed from proximity switch 18. This removal of contact allows generation of a restart signal (either through a new signal or through cessation of a continuous stop signal) to be sent to the transport device. Belts 20 thus move again in direction 30 until sensor plate 16 again contacts switch 18 so that a stop signal is generated.

The start and stop cycle is continuously repeated.

The positioning of the entire control device 10 and thus feed finger 12 with respect to suction wheel 101 can be altered to accurately position stack 35. FIG. 1 shows a horizontal control knob 52 and a vertical control knob 54 for positioning the control device 10, the knobs 52, 54 being located on an outer surface of a frame 80 and defining an adjustment device. Horizontal control knob 52 is connected by a flex shaft 56, shown schematically, to a horizontal slideway 62, while vertical control knob 54 is connected by another flex shaft 58 to a vertical slideway 64.

Figure 2:
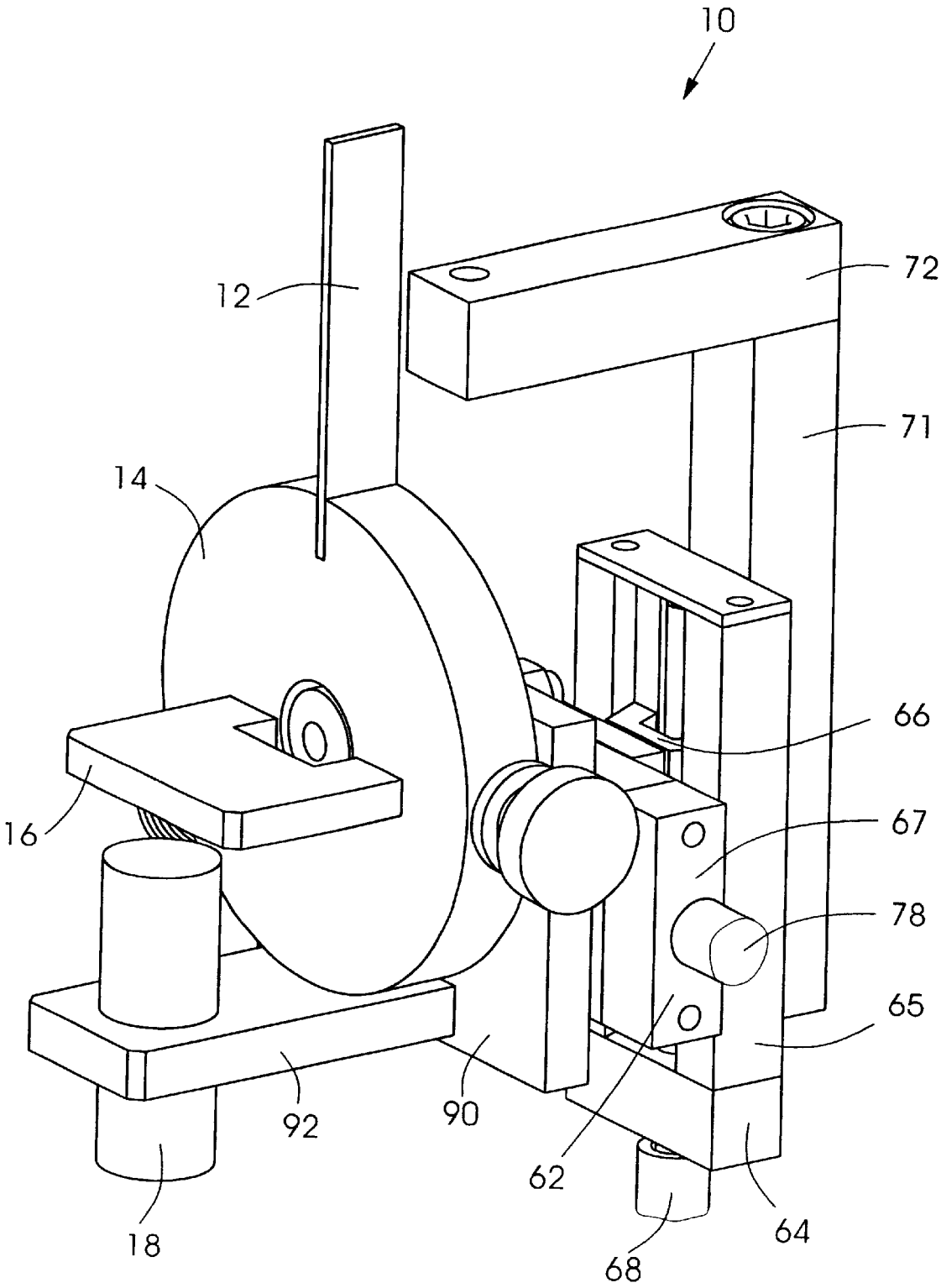
FIG. 2 shows a perspective view of the sheet advance device of FIG. 1.

As shown in FIG. 2, which shows a perspective view of control device 10 detached from the frame 80 of FIG. 1, vertical slideway 64 has a housing 65 fixedly attached to a support arm 71 fixed to an attachment arm 72. Attachment arm 72 may be fixed, for example by screws, to frame 80 of sheet advance device 1. Vertical slideway 64 includes a movable plate 66 onto which a frame 67 of horizonal slideway 62 is attached. Vertical slideway 64 also has a rotatable screw 68 rotatably supported in which interacts with interior threading of movable plate 66, which dovetails slidingly with the housing 65. When screw 68 is rotated through knob 52 and flex shaft 56, plate 66 moves up or down. Horizontal slideway 62 thus moves up or down as well. A horizontally-moving plate of horizontal slideway 62 supports a support plate 90, on which disk 14 is rotatably supported and spring-loaded opposite direction 32.

A rotation of a rotatable screw 78 of horizontal slideway 62 through knob 54 and flex shaft 58 thus moves the support plate in a horizontal direction, and thus moves support plate 90 horizontally. Since proximity switch 18 is supported on a support arm 92 fixed to plate 90, proximity switch 18 and disk 14 move similar distances whenever slideways 62 and 64 are moved.

The movement of slideways 62 and 64 thus can adjust the vertical and horizontal position of feed finger 12. This adjustment may be performed by adjusting knobs 52 and 54 located on a frame of the adjustment device.

The flex shafts of the present device may be flexible steel cables or tightly-wound steel coils, preferably covered by a polymeric sheath.

Alternatively, a remote control device or infrared device could be used as the adjustment device to rotate the shafts of the slideways through motors, or to position electric positioning motors which replace the slideways.

"Slideway" as defined herein can include any type of device using a rotating screw with a movable support having interior threading.

"Feed finger" as defined herein can include any type of device for physically contacting sheets.

"Externally located" as defined herein means that the adjustment device is not directly connected to the control device, but rather is connected through an extending element such as flex shaft to the control device.

What is claimed is:

1. A sheet advance device comprising:

a transport device for transporting a stack of sheets in a first direction;

a feed finger located in the path of the stack of sheets for contacting the stack of sheets;

a sensor for detecting a movement of the feed finger; and an externally-located adjustment device for positioning of the feed finger.

2. The sheet advance device as recited in claim 1 further comprising a frame, the adjustment device being located on the frame.

3. The sheet advance device as recited in claim 1 further comprising a disk mounted rotatably on a support assembly, the support assembly including two perpendicular slideways for positioning the disk, the slideways being connected to the adjustment device.

4. The sheet advance device as recited in claim 1 wherein the adjustment device preferably two knobs located on an outer surface of the frame.

5. The sheet advance device as recited in claim 4 further comprising two flex shafts connected to the two knobs.

6. The sheet advance device as recited in claim 1 further comprising a horizontal slideway for moving the feed finger horizontally with respect to the frame and a vertical slideway for moving the feed finger vertically with respect to the frame.

7. The sheet advance device as recited in claim 1 wherein the sensor includes a sensor plate in fixed relation to the feed finger and a proximity switch located next to the sensor plate.

8. The sheet advance device as recited in claim 1 further comprising a screw and at least one flex shaft connected to the adjustment device, the flex shaft for rotating the screw, the screw interacting with threading of a support so as to move the feed finger.

9. A method for advancing sheets on a transport device comprising the steps of:

moving a stack of sheets on the transport device against a feed finger so as to move the feed finger in a first direction;

sensing the movement of the feed finger so as to generate a stop signal;

stopping the transport device as a function of the stop signal;

removing individual sheets from the stack of sheets so as to reduce the stack in a direction opposite the first direction and move the feed finger opposite the first direction;

moving the transport device in the first direction after the removing step; and adjusting a position of the feed finger through an externally-located adjustment device.

10. The method as recited in claim 9 wherein the adjusting step includes moving the feed finger vertically.

11. The method as recited in claim 9 wherein the adjusting step includes moving the feed finger horizontally.

12. The method as recited in claim 9 wherein the adjusting step includes rotating a knob on a frame and rotating a flex shaft through rotation of the knob.

13. The method as recited in claim 12 wherein a rotation of the flex shaft rotates a screw so as to move a support having interior threading.

14. A sheet advance device comprising:

a frame;

a feed finger for contacting a stack of sheets;

a first slideway supported on the frame for moving the feed finger in a first direction with respect to the frame;

a second slideway supported on the frame for moving the feed finger in a direction different from the first direction; and an adjustment device located on or outside of the frame for moving the first and second slideways.

15. The sheet advance device as recited in claim 14 further comprising two flex shafts connected to the first and second slideways and wherein the adjustment device includes two knobs.

* * * * *